United States Patent [19]

Fischman

[11] 4,234,816

[45] Nov. 18, 1980

[54] CATHODE RAY TUBE WITH INTERNAL ARC SUPPRESSOR AND PROTECTIVE SPARK GAP

[75] Inventor: Martin Fischman, Seneca Falls, N.Y.

[73] Assignee: GTE Products Corporation, Stamford, Conn.

[21] Appl. No.: 30,417

[22] Filed: Apr. 16, 1979

[51] Int. Cl.[3] ..... H01J 29/88; H01J 29/94; H01J 29/96

[52] U.S. Cl. ..... 313/479; 313/178; 313/481; 315/3

[58] Field of Search ..... 313/479, 481, 174, 180, 313/178; 315/3

[56] References Cited

U.S. PATENT DOCUMENTS

| | | | |
|---|---|---|---|
| 3,295,008 | 12/1966 | Gallaro et al. | 315/3 |
| 3,882,348 | 6/1975 | Paridaens | 315/3 X |
| 3,909,655 | 9/1975 | Grimmett et al. | 313/451 X |
| 3,961,221 | 6/1976 | Benda et al. | 313/481 |
| 4,101,803 | 7/1978 | Retsky et al. | 313/479 X |
| 4,143,298 | 3/1979 | Bing et al. | 315/3 |

*Primary Examiner*—Palmer C. Demeo
*Attorney, Agent, or Firm*—William H. McNeill

[57] ABSTRACT

Processing of arc suppression color cathode ray tubes is enhanced by providing a spark gap (42) across a limiting resistor used in the tube. The use of the spark gap allows the use of lower processing voltages and enhances electron gun clean up by burning off loose particles.

2 Claims, 2 Drawing Figures

CATHODE RAY TUBE WITH INTERNAL ARC SUPPRESSOR AND PROTECTIVE SPARK GAP

TECHNICAL FIELD

This invention relates to color cathode ray tubes of the arc suppressor variety; i.e., tubes having, at least in the neck area, an internal conductive coating exhibiting a very high electrical resistance.

BACKGROUND ART

As the anode voltages of color cathode ray tubes have risen (currently about 30 KV) and the electron guns have gotten smaller, severe problems of internal arcing during normal tube operation have occurred. In order to obviate these problems tube manufacturers have employed high resistance conductive coatings on the interior of the tubes. Also, to avoid shorting out these coatings, it has been the practice to place a resistor in series on the commonly used antenna getter employed therewithin. These getters are attached at one end to the final electrode of the gun and extend therefrom into the funnel and lie on the conductive coating. Such a system is shown and described in U.S. Pat. Nos. 4,101,803 and 3,961,221. While these techniques have solved the problems of internal arcing during normal tube operation, they have created problems in tube processing. These latter problems arise from the fact that tube manufacturers employ internal arcing between gun electrodes during the final processing of the tube to "clean up the structures." This forced internal arcing burns up loose internal particles which may adhere to the gun structures as well as removing any unwanted burrs or protrusions on the electrodes. The high resistance coating and insulated getter structure, so useful in preventing unwanted arcing during normal tube operation, has thus greatly hindered the final processing of the tubes, forcing tube manufacturers to use ever higher voltages during this final processing.

DISCLOSURE OF THE INVENTION

Accordingly, it is an object of this invention to obviate the disadvantages of the prior art.

It is another object of the invention to enhance tube processing of arc suppression tubes.

It is yet another object of the invention to provide a structure which facilitates the processing of such tubes.

These objects are accomplished in one aspect of the invention by the provision, in an arc suppression type color cathode tube, of a spark gap across the getter resistor. This gap defines a sparking potential higher than that existing between any adjacent pair of gun electrodes but lower than that inherently existing across the resistor. The use of this gap thus preserves the integrity of the arc suppression coating during normal tube operation but allows the use of lower processing voltages since, during processing the gun gaps will arc first and trigger the resistor gap. When this occurs the energy in the capacitor formed by the internal coating and the external coating on the internal coating to free space and proximity and the power supply are all available for normal processing since the limiting resistor is shorted out by the arc.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
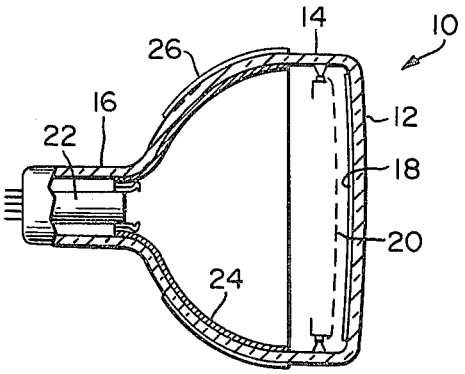
FIG. 1 is a diagrammatic sectional view of a color cathode ray tube.

Referring now to the invention with greater particularity there is shown in FIG. 1 a more or less typical color cathode ray tube 10, having a face plate 12, body 14 and neck 16. On the inside surface of face plate 12 is a patterned cathodoluminescent screen 18 and adjacent thereto is a perforated shadow mask 20. A suitable electron gun 22 comprised of a plurality of axially aligned electrodes is positioned in neck 16. An internal electrically conductive coating 24 is deposited on the interior surface of body 14 and, in arc suppression tubes, at least the area of coating 24 on the interior of neck 16 has a very high electrical resistance. A conductive coating 26 also occupies specific areas on the outside of body 14.

Figure 2:
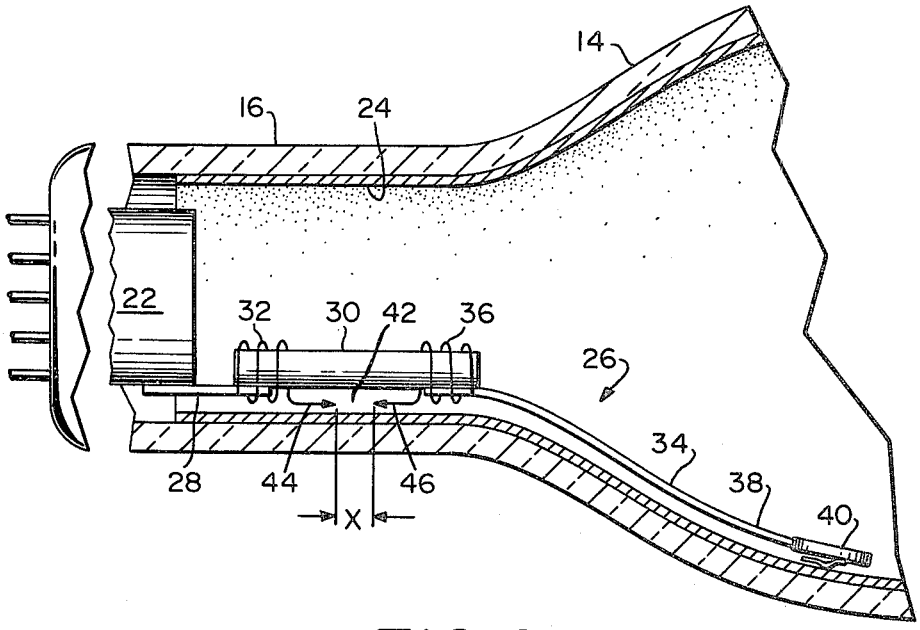
FIG. 2 is a partial sectional view illustrating an embodiment of the invention.

Referring now to FIG. 2, an antenna getter 26 is shown mounted within tube 10. In this instance the antenna getter 26 comprises a support 28 in the form of a metallic rod which is attached at one end to the final electrode of gun 22, a limiting resistor 30 of about 100,000 ohms attached to the other end of support 28 as by a first wire wrap 32 and a getter wand 34 attached by a second wire wrap 36 to the other end of resistor 30. The distal end 38 of getter wand 34 carries a conventional getter ring 40.

With this type of construction the desired spark gap 42 is conveniently and economically formed by the inwardly facing ends 44 and 46 of the pair of wire wraps. For a typical color cathode ray tube employing an anode voltage of 30 KV, the spark gap distance X can be about 0.080" (2mm).

Employment of this unique structure permits adequate processing of arc suppression color tubes at near normal processing voltages; i.e. about 40 KV D.C. on the average, as opposed to the previously employed ranges which are about 50% higher. Moreover, the results should be substantially equivalent to the clean up procedures of tubes which do not employ the high resistance internal coating.

While there have been shown and described what are at present considered the preferred embodiments of the invention, it will be apparent to those skilled in the art that various changes and modifications can be made herein without departing from the scope of the invention as defined by the appended claims.

I claim:

1. In a cathode ray tube including a high resistance coating on the interior thereof, an electron gun having a plurality of axially aligned electrodes having varying spaces therebetween and an antenna getter mounted upon the final one of said electrodes, said antenna getter being substantially electrically insulated from said final electrode by a resistor, the improvement comprising: a spark gap across said resistor defining a sparking potential greater than the sparking potential existing between any adjacent pair of electrodes of said electron gun at normal operating tube voltages and lower than that inherently existing across said resistor.

2. The cathode ray tube of claim 1 wherein said spark gap comprises a pair of wire wraps, a first one of said wire wraps having one end electrically connected to said final electrode and a free end; a second one of said wire wraps having one end electrically connected to said getter and a free end; said free ends of said first and second wire wraps facing each other and defining therebetween said sparking potential.

* * * * *